United States Patent [19]

Horiuchi et al.

[11] Patent Number: 4,947,466

[45] Date of Patent: Aug. 7, 1990

[54] TENNIS BALL

[75] Inventors: Kuniyasu Horiuchi, Kobe; Yoshinobu Makamura, Nishinomiya, both of Japan

[73] Assignee: Sumitomo Rubber Industries, Ltd., Kobe, Japan

[21] Appl. No.: 399,129

[22] Filed: Aug. 28, 1989

Related U.S. Application Data

[62] Division of Ser. No. 190,560, May 5, 1988, abandoned.

[30] Foreign Application Priority Data

Aug. 5, 1987 [JP] Japan ..... 62-69239
Jun. 4, 1988 [JP] Japan ..... 63-46406

[51] Int. Cl.[5] ..... A63B 39/00; A63B 69/38

[52] U.S. Cl. ..... 273/61 C; 273/29 A; 273/DIG. 020

[58] Field of Search ..... 273/61 R, 29 A, 020, 273/61 C, 61 D

[56] References Cited

U.S. PATENT DOCUMENTS 4,249,730 2/1981 Frisk ..... 273/61 C
4,739,989 4/1988 Prinz et al. ..... 273/29 A

FOREIGN PATENT DOCUMENTS 85104619.3 2/1986 European Pat. Off. .
DE3533640 4/1987 Fed. Rep. of Germany .

*Primary Examiner*—George J. Marlo
*Attorney, Agent, or Firm*—Armstrong, Nikaido, Marmelstein, Kubovcik & Murray

[57] ABSTRACT

A hollow tennis ball which comprises a hollow core of elastic material which encloses an interior space, and a layer of substantially felt-like material which is applied to the outer surface of the hollow core. The overall weight of the hollow tennis ball is substantially between 30 and 54 grams. The pressure in the interior space is substantially from 0 to 0.7 kg/cm$^2$ higher than atmospheric pressure. The thickness of the hollow core is substantially between 2.2 and 4.5 mm. The forward deformation of the hollow tennis ball is substantially from 6.5 to less than 12 mm under loading force of 3.5 and 18 pounds. The return deformation is substantially from 10.5 to less than 15 mm after it has deformed to 2.54 cm under a loading force of 18 pounds.

2 Claims, 1 Drawing Sheet

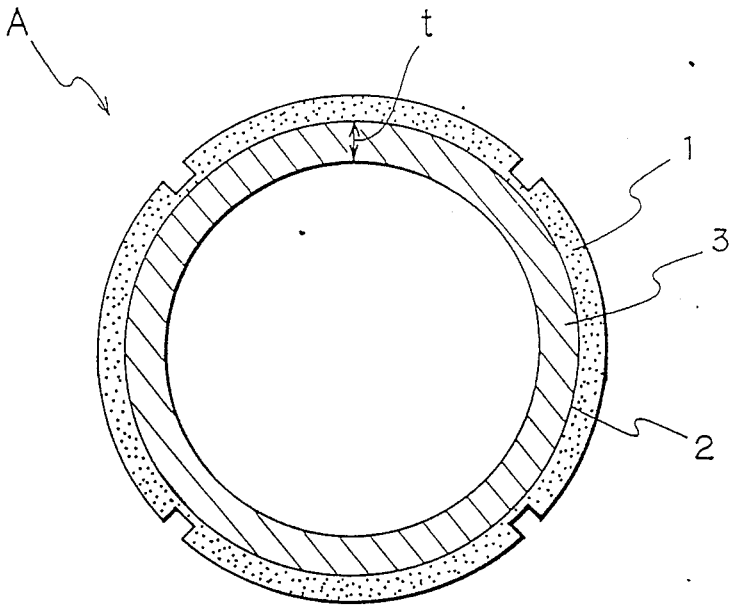
A
t
1
3
2

TENNIS BALL

This is a division of application Ser. No. 190,560 filed May 5, 1988, now abandoned.

BACKGROUND OF THE INVENTION

The present invention relates to tennis balls, and more particularly to tennis balls having a small weight and rebound so that even children of lower age having little experience, adult beginners and adults who lack physical strength and athletic ability, can play tennis without difficulty corresponding to physical strength and skill thereof.

Tennis balls have a standard of ITF (International Tennis Federation), and only those complying with the standard are used in regular games. Usually, general tennis players also use such tennis balls as complying with the above-mentioned standard. Though some tennis balls out of the standard are on the market as practice balls, these balls are not largely out of the standard. That is, there are not much different from the balls complying with the standard and those not complying with the standard in weight, rebound, and the like. The present ITF standards are shown hereinafter for references sake.

| | |
|---|---|
| Weight | 56.7 to 58.5 g |
| Outer diameter | 6.35 to 6.67 cm |
| Forward deformation | 0.56 to 0.74 cm |
| Return deformation | 0.89 to 1.08 cm |
| Rebound | 135 to 147 cm |

Children of tender age, from 4 to 12 years old, particularly those who play tennis for the first time or have little experience adult beginners and adults who lack physical strength and athletic ability find great difficulty in playing tennis with the above-mentioned balls, since they are too heavy, they bounce too much, they are too hard, they fly too much, particularly their speed becomes too high after bounce for such players. Namely, the tennis balls complying with the standard of ITF made for adults are not suitable for the children of tender age, since they are immature in physical strength, athletic ability and physical constitution. As a result, children are slow in progress for tennis as compared with other sports, and it brings to them a concept that tennis is a dull or uninteresting sport. Then their interesting move from tennis to other sports such as baseball and soccer. Moreover, there is a problem that the children is injured when they continuously play tennis with the above-mentioned balls which overstresses to their wrists, shoulders and waists and the like. These problems apply the above-mentioned adult beginners and the like.

In order to solve the above-mentioned problems, there is proposed a big ball having about 3 to 11% larger diameter than that of the ITF standard ball which enables players to play leisurely (Japanese Unexamined Patent Publication No. 48385/1986). Players can play tennis leisurely by this type of tennis balls indeed since ball speed becomes slow not only in flight but also after bound. However, the balls have such disadvantages as they are heavy since the weights are from 54 to 58 g, as the rebound is high since it is about 146 cm, and as the internal pressure of the hollow core is high since it is 0.8 to 1.0 kg/cm$^2$ higher than the atmospheric pressure. As a result, it is very difficult for children of tender age to play tennis with the big balls as well as ITF standard balls, since children feel they are heavy and they bounce high. Namely, there are no substantial differences between the big balls and ITF standard balls for children of tender age and for adult beginners. The above-mentioned problems are, therefore, not solved by the big balls.

It is an object of the present invention to provide a tennis ball which corresponds to physical constitution, physical strength and athletic ability of players whereby they can play tennis easily, their progress in tennis is accelerated and their amusement in tennis is increased. Namely, the present invention includes three kinds of tennis ball. Each kind of tennis ball lowers impact force and ball speed. However, in the tennis ball of the first invention, the physical properties of the ball such as weight and internal pressure thereof are selected mainly suitable for children of tender age, from about 4 to 12 years old. In the tennis ball of the second invention, the physical properties are selected mainly suitable for children from about 6 to 12 years old who make progress in handling the ball by training with the tennis ball of the first invention to a certain degree. In the tennis ball of the third invention, the physical properties are selected mainly suitable for adult beginners or adults who lack physical strength and athletic ability.

SUMMARY OF THE INVENTION

A tennis ball of the present invention comprises a hollow core made of a rubber composition, a felt covering the hollow core, wherein (1) a tennis ball of the first invention is characterized in that the weight of the ball is from 30 to 50 g, the internal pressure of the hollow core is 0 to 0.4 kg/cm$^2$ higher than the atmospheric pressure, the thickness of the hollow core is from 2.2 to 3.0 mm, the hardness of the rubber of the hollow core is from 55 to 70 based on JIS A standard, and rebound is from 90 to 120 cm; (2) a tennis weight of the ball is from 45 to 54 g, the internal pressure of the hollow core is 0 to 0.4 kg/cm$^2$ higher than the atmospheric pressure, the thickness of the hollow core is from 3.0 to 4.5 mm, the hardness of the rubber of the hollow core is from 60 to 75 based on JIS A standard and rebound is from 125 to 135 cm; and (3) a tennis ball of the third invention is characterized in weight of the ball is from 30 to 52 g, the internal pressure is 0.4 to 0.7 kg/cm$^2$ higher than the atmospheric pressure, the thickness of the hollow core is from 2.2 to 3.0 mm, the hardness of the rubber of the hollow core is from 55 to 70 based on JIS A standard (Japanese Industrial Standard) which is similar to a Shore A hardness scale, and rebound is from 130 to 145 cm.

As described above, it is an object of the present invention is to provide a tennis ball which enables those of tender age, beginners, those of weak physical strength and those of inferior athletic ability, to make progress in tennis with ease by lessening impact force and by reducing ball speed, particularly ball speed after rebound.

In order to realize the above-mentioned object, in the present invention, the weight, the internal pressure, the thickness and the hardness of the rubber of the hollow core are limited in a specific range respectively, so that the impact force and the bal speed are lowered.

BRIEF EXPLANATION OF THE DRAWING

FIG. 1 shows a schematic sectional view of an embodiment of a tennis ball of the present invention.

DETAILED DESCRIPTION

Referring now to the drawing for more complete understanding of the present invention, there is shown a tennis ball.

FIG. 1 shows a schematic sectional view of a tennis ball A of an embodiment of the present invention. In the drawing, numeral 2 indicates a hollow core, numeral 3 indicates a rubber layer of the hollow core, and numeral 1 indicates a felt covering the hollow core.

In making a tennis ball A of the present invention, there is no limitation for rubber composition composing the hollow core 2 provided that it satisfies the weight and the rebound mentioned hereinafter. Namely, material selected from the group consisting of nitrile rubber, synthetic and natural isoprene rubber, butadiene rubber, EPM, EPDM, butyl rubber and styrene-butadiene rubber can be used for rubber material. A mixture of two or more selected among them can also be used as rubber material.

A tennis ball A of the present invention is characterized in that the weight, the internal pressure and the thickness and the hardness of the rubber of the hollow core and rebound are limited in a specific range corresponding to player's physical strength, athletic ability and the like.

Hereinafter is a detailed explanation of a ball of the first invention, a ball of the second invention, and a ball of the third invention in this order.

In this specification, it is explained that a certain value in weight of the tennis ball, for example, is preferable for one kind of tennis ball, and also it is explained that the same value in weight is too heavy for other kinds of tennis ball. The reason is that the weight is selected in accordance with the skill of player in each kind of tennis ball of the present invention. For a tennis ball of the present invention, it is not significant to individually select physical properties such as the thickness and internal pressure of the hollow core. But it is significant to select them with keeping a certain relation among them, so that the distinguished features can be realized. Namely, the essence of the present invention resides in the combination of physical properties of the tennis ball.

A tennis ball of the first invention is designed for children of tender age, from about 4 to 12 years old. In designing the tennis ball of the first invention, players having the weakest physical strength and poorest athletic ability among tennis players are taken into consideration. Accordingly, the weight of the ball is lessened, the thickness of the hollow core is thinned, the hardness of the rubber is lowered, the internal pressure of the hollow core is zero or a little higher than the atmospheric pressure, so that the rebound, ball speed and impact force at the time of striking are lowered for them to handle the ball very easily. More particularly, in the tennis of the first invention, the weight is from 30 to 50 g, the internal pressure of the hollow core is 0 to 0.4 $kg/cm^2$ higher than the atmospheric pressure, the thickness of the hollow core is from 2.2 to 3.0 mm, the hardness of the rubber of the hollow core is from 55 to 70 based on JIS A standard, and rebound is from 90 to 120 cm. Children from 4 to 12 years old, who have weak physical strength, make rapid progress in handling balls when they start playing tennis with the ball of the first invention.

When the weight of a ball exceeds 50 g, players feel it heavy on striking the same. On the contrary, when the weight of a ball is less than 30 g, the flight line of the ball becomes unstable and the ball loses its controllability. When the internal pressure of the hollow core exceeds 0.4 $kg/cm^2$, there are such disadvantages as the rebound becomes higher, the ball flies too much, and the ball speed after rebound is felt fast. When the thickness of the hollow core, i.e. the thickness of the rubber layer t is less than 2.2 mm, there are such disadvantages as the rebound is low, players feel the ball very soft at the time of striking it, and the flight property is poor. On the contrary, when the thickness exceeds 3.0 mm, there are such disadvantages as players feel the ball is very hard and heavy, and it flies too much. The hardness of the rubber is from 55 to 70 based on JIS A standard, i.e. a value measured by JIS A (Japanese Industrial Standard) type or a Shore A hardness meter is from 55 to 70. When the hardness is less than 55, there are such disadvantages as a ball becoming very soft, it does not sufficiently fly, and the rebound being low. On the contrary, when the hardness exceeds 70, there are such disadvantages as a ball becoming too hard, the ball speed becoming high and flying too much. In addition, when rebound is less than 90 cm, the rebound is too low, and when rebound exceeds 120 cm, the rebound is too high. In both cases, rebound is not preferable for playing since players feel some difficulty at the time of striking it.

It is preferable that the forward deformation is from 10.0 to 18.0 mm. When the forward deformation is less than 10.0 mm, there are such disadvantages as a ball becomes too hard, player cannot return the ball under his control, it flies too much and the ball speed after rebound becomes high. On the contrary, when the forward deformation exceeds 18.0 mm, there are such disadvantages as a ball becomes very soft, the rebound height becomes low and it does not sufficiently fly.

Further, it is preferable that the return deformation is from 13.5 to 20.0 mm. When the return deformation is less than 13.5 mm, there are such disadvantages as players feel a ball hard, and it flies too much. On the contrary, when the return deformation exceeds 20.0 mm, there are such disadvantage as players feel a ball soft and as it does not sufficiently fly.

A detailed description of a tennis ball of the second invention is hereinafter more fully explained.

A tennis ball of the second invention is designed for the children of tender age, from about 6 to 12 years old, who have been trained for a certain degree with the tennis ball of the first invention and then they can handle the ball well, and who have more athletic ability than those who use the tennis ball of the first invention. Namely, the tennis ball of the second invention is a ball which is used by children from about 6 to 12 years old who have been trained with the tennis ball of the first invention until they can use a regular tennis ball. Even the weight of the tennis ball of the second invention is designed similar to the tennis ball of the first invention, though in order for the children to be able to use the regular ball as smooth as possible, the thickness of the hollow core is thickened, the hardness of the rubber is hardened (however the hardness is lower than that of the regular ball), and the internal pressure of the hollow core is 0 or a little higher than the atmospheric pressure. More particularly, the weight of the ball is from 45 to 54 g. The internal pressure of the hollow core is 0 to 0.4 kg/cm$^2$ higher than the atmospheric pressure. The thickness of the hollow core is from 3.0 to 4.5 mm. The hardness of the rubber of the hollow core is from 60 to 75 based on JIS A standard. The rebound height is from 125 to 135 cm. The rebound, the ball speed and impact force of the tennis ball of the second invention are smaller than those of the regular ball, and they are larger than those of the tennis ball of the first invention. Namely, the tennis ball of the second invention becomes a little bit similar to the regular ball. If the children have trained with the tennis ball of the second invention, and then they use the regular ball, they can make progress in tennis smoothly.

The weight of the ball, the internal pressure and thickness of the hollow core and the like are not selected within the above-mentioned limitation, there are the same disadvantages as described about the tennis ball of the first invention.

It is preferable that the forward deformation is from 6.5 to 8.0 mm and that the return deformation is from 10.5 to 11.5 mm.

When the forward deformation is less than 6.5 mm, there are such disadvantages as a ball becoming hard, the ball speed becomes high, and players feel the ball hard and heavy at the time of striking it. On the contrary, when the forward deformation exceeds 8.0 mm, there are such disadvantages as the ball becoming soft and being unable to sufficiently fly.

In addition, when the return deformation is less than 10.5 mm, there are such disadvantages as the ball becoming hard, it flies too much and players feel it heavy. On the contrary, the forward deformation exceeds 11.5 mm, there are such disadvantages as the ball becoming soft and not being able to sufficiently fly.

Finally, there is explained the tennis ball of the third invention.

The tennis ball of the third invention is designed for adult beginners and adults who have weak physical strength and inferior athletic ability. The tennis ball of the third invention, therefore, is corresponding to those who are superior to players corresponding to the tennis balls of the first and the and, and also to old players, who have much lowered their physical strength, with tennis experience for a certain degree. In order to get higher rebound and higher ball speed than those of the tennis ball of the first invention, the internal pressure of the hollow core is selected at 0.4 to 0.7 kg/cm$^2$ higher than the atmospheric pressure. Concretely speaking, the weight of the ball is from 30 to 52 g. The internal pressure of the hollow core is 0.4 to 0.7 kg/cm$^2$ higher than the atmospheric pressure. The thickness of the hollow core is from 2.2 to 3.0 mm. The hardness of rubber of the hollow core is from 55 to 70 based on JIS A standard. The rebound is from 130 to 145 cm.

There are the same disadvantages and problems as described in the tennis ball of the invention and in the tennis ball of the second invention when the weight of the ball, the internal pressure and the thickness of the hollow core and the like are out of the specific range.

It is preferable that the forward deformation is from 8.5 to 11.5 mm, and that the return deformation is from 10.5 to 14.0 mm.

When the forward deformation is less than 8.5 mm, there are such disadvantages as the ball becomes hard the ball speed becomes higher and player feel the ball hard and heavy at the time of striking it. On the other hand, when the forward deformation exceeds 11.5 mm, there are such disadvantages as the ball becomes soft and as it does not fly sufficiently.

In addition, when the return deformation is less than 10.5 mm, there are such disadvantages as the ball becomes hard, it flies too much, and players feel it heavy at the time of striking it. On the other hand, when the return deformation exceed 11.5 mm, there are such disadvantages as the ball becomes soft and it does not fly sufficiently.

In the above explanation, it is mentioned that the tennis ball A of the present invention is designed for players who have inferior physical strength and athletic ability. The application of the tennis ball of the present invention, however, is not limited to the players as mentioned above. Players who have long experience in tennis playing and play well, enjoy playing tennis leisurely with the ball of the present invention since the impact force is weak and the ball speed is low.

Fundamentally, the tennis ball of the present invention is designed to display its characteristics when it is used in a tennis court of standard size with a net of standard height. According to circumstances, however, it can be used in a small sized tennis court or with a net of lower height.

The tennis ball of the present invention can be made by the same manufacturing process as that of the standard tennis ball.

Next there is explained a tennis ball of the present invention based on Examples and Comparative Examples. The scope of the present invention is not, however, limited to the examples. Among the Examples, Examples 1 to 5 correspond to the tennis ball of the first invention, Examples 6 to 10 correspond to the tennis ball of the second invention, and Examples 11 to 14 correspond to the tennis ball of the third invention.

EXAMPLES 1 to 14

Composition were prepared according to Table 1 (Table 1 is shown by PHR (Per Hundred Rubber)), thereafter the hollow cores were covered with felts to obtain tennis balls.

TABLE 1

| | Natural rubber | High styrene SBR *1 | Zinc oxide | Stearic acid | Wood flour | Hydrou silica *2 | Sulfur | DM | DPG |
|---|---|---|---|---|---|---|---|---|---|
| Example 1 | 100 | — | 7.0 | 1.0 | — | 16 | 4.2 | 2 | 1 |
| Example 2 | 100 | — | 7.0 | 1.0 | — | 16 | 4.0 | 2 | 1 |
| Example 3 | 100 | — | 8.0 | 1.0 | — | 16 | 3.8 | 2 | 1 |
| Example 4 | 100 | — | 8.0 | 1.0 | — | 18 | 4.0 | 2 | 1 |
| Example 5 | 100 | — | 7.0 | 1.0 | — | 14 | 3.8 | 2 | 1 |
| Example 6 | 82 | 18 | 3.0 | 1.0 | 8 | 5 | 3.8 | 2 | 1 |
| Example 7 | 82 | 18 | 3.0 | 1.0 | 8 | 8 | 3.8 | 2 | 1 |
| Example 8 | 82 | 18 | 5.0 | 1.0 | 6 | 6 | 3.6 | 2 | 1 |
| Example 9 | 82 | 18 | 3.0 | 1.0 | 6 | 5 | 3.4 | 2 | 1 |
| Example 10 | 82 | 18 | 3.0 | 1.0 | 10 | 5 | 3.8 | 2 | 1 |
| Example 11 | 100 | — | 7.0 | 1.0 | — | 16 | 4.0 | 2 | 1 |

TABLE 1-continued

| | Natural rubber | High styrene SBR *1 | Zinc oxide | Stearic acid | Wood flour | Hydrou silica *2 | Sulfur | DM | DPG |
|---|---|---|---|---|---|---|---|---|---|
| Example 12 | 100 | — | 8.0 | 1.0 | — | 17 | 4.1 | 2 | 1 |
| Example 13 | 100 | — | 7.0 | 1.0 | — | 14 | 4.0 | 2 | 1 |
| Example 14 | 100 | — | 9.0 | 1.0 | — | 14 | 3.8 | 2 | 1 |

*1 Nippol 2007J made by Nippon Zeon Co., Ltd.
*2 Hydrou silica made by Nippon Silica Kogyo Kabushiki Kaisha Rubber composition were prepared by kneading a rubber and ingredients other than sulfur and an accelerator in a Banbury mixer, and then kneading the mixture with sulfur and the accelerator on rolls.

The compositions were formed into sheets, and extruded by an extruder in the form a rod. After cutting the rods into pieces suited for a mold for preparing half-shells, the pieces were placed in the molds and compression-molded at 160° C. for 2 minutes to produce half-shells. A pair of the half-shells were placed in a mold for preparing ball cores and compression-molded at 150° C. for 12 minutes to produce tennis ball cores.

The results of measurement of physical properties of the obtained tennis balls are shown in Table 2.

The physical properties shown in Table 2 were measured as follows:

Forward Deformation

The measurement was carried out with a Stevens machine.

A tennis ball was subsequently compressed about 2.54 cm in three direction at right angles to each other. This procedure was repeated 3 times. That is to say, the ball was compressed 9 times total. After the above preliminary compression, the deformation was measured in 2 hours according to the following manner. The ball was compressed with a load of 3.5 pounds (1.575 kg) and the deformation was measured, and the ball was then compressed with a load of 18 pounds (8.165 kg) and the deformation was measured. The forward deformation is expressed by the difference between the deformation by a load of 3.5 pounds and the deformation by a load of 18 pounds.

Return Deformation

After measuring the deformation in the above forward deformation test, the ball was compressed so that the deformation was 2.54 cm. Then the compression was reduced to a load of 18 pounds, and the deformation was measured.

Bounce

A tennis ball was dropped from a height of 254 cm onto a concrete base, and the bounce of the ball was measured.

COMPARATIVE EXAMPLES 1 to 2

The physical properties of Comparative Examples 1 to 2 are shown in Table 2, wherein Comparative Example 1 is Dunlop Fort Yellow (made by Sumitomo Rubber Ind. Ltd.,) and Comparative Example 2 is Rally (made by Wilson).

TABLE 2

| | Weight (g) | Outer diameter (mm) | Internal pressure of core (kg/cm$^2$) | Thickness of core (mm) | Hardness of rubber (JIS A) | Bound (cm) | Forward deformation (mm) | Return deformation (mm) | Remarks |
|---|---|---|---|---|---|---|---|---|---|
| Example 1 | 40 | 64 | 0 | 2.8 | 66 | 110 | 12.7 | 15.4 | |
| Example 2 | 37 | 63 | 0 | 2.6 | 63 | 105 | 13.7 | 16.9 | |
| Example 3 | 40 | 66 | 0 | 2.4 | 60 | 102 | 15.2 | 17.8 | *1 |
| Example 4 | 44 | 65 | 0.2 | 2.6 | 63 | 115 | 11.8 | 14.2 | |
| Example 5 | 40 | 64 | 0.3 | 2.9 | 58 | 117 | 11.6 | 13.8 | |
| Example 6 | 50 | 65.5 | 0 | 4.2 | 70 | 131 | 6.8 | 10.9 | |
| Example 7 | 46 | 65.0 | 0 | 3.3 | 72 | 126 | 7.1 | 11.1 | |
| Example 8 | 53 | 65.3 | 0 | 3.8 | 69 | 133 | 7.5 | 11.4 | *2 |
| Example 9 | 48 | 64.8 | 0.2 | 3.5 | 66 | 130 | 7.1 | 11.1 | |
| Example 10 | 52 | 65.5 | 0 | 4.3 | 74 | 132 | 6.6 | 10.7 | |
| Example 11 | 40 | 66.1 | 0.6 | 2.8 | 65 | 140 | 9.4 | 11.4 | |
| Example 12 | 37 | 66.8 | 0.65 | 2.4 | 67 | 141 | 9.7 | 11.5 | *3 |
| Example 13 | 40 | 65.7 | 0.50 | 2.9 | 62 | 138 | 10.3 | 12.4 | |
| Example 14 | 46 | 67.5 | 0.45 | 2.7 | 58 | 139 | 10.8 | 13.0 | |
| Comparative Example 1 | 57.6 | 65.5 | 0.8 | 3.4 | 75 | 144 | 6.3 | 9.0 | *4 |
| Comparative Example 2 | 54.1 | 69.9 | 0.9 | 2.9 | 75 | 146.1 | 6.4 | 9.2 | *5 |

Remarks
*1: Strike feeling, hardness, flight and rebound are good for children from 4 to 12 years old. It enables them to play tennis like adult players play tennis with a standard ball.
*2: Strike feeling, hardness, flight and rebound are good for children from 6 to 12 who have been trained with the tennis ball of the first invention. It enables them to play with a standard ball smoothly.
*3: It enables adults who play tennis for the first time, who have weak physical strength and inferior athletic ability to handle with ease, to enjoy tennis and to make a rapid progress.
*4: The weight is heavy, the ball speed is high and rebound is high, so that players who play tennis for the first time cannot play tennis well.
*5: The weight is heavy and players feel it hard. The rebound is high and the ball speed is high after bound, so that the handling of it is difficult.

From Table 2, it is understandable that the tennis balls of Examples according to the present invention are suitable for children of tender age and adult beginners since the rebound of them is low and strike feeling is good.

According to the present invention, as described hereinabove, there can be realized a tennis ball having suitable physical properties i.e. rebound, speed, and hardness for not only children of tender age who are inferior to adult in physical constitution and athletic abilities, but also adult beginners and adults who have weak physical strength and inferior athletic ability. Consequently, the tennis ball of present invention can hasten their progress in tennis playing and can increase their interesting for tennis The effect is improved when they use a light and short racket for children in playing.

While the invention has been particularly shown and described in reference to preferred embodiments thereof, it will be understood by those skilled in the art that changes in form and details may be made therein without departing from the spirit and scope of the invention.

What we claim is:

1. A hollow tennis ball comprising:

(a) a hollow spherical core of elastic material enclosing an interior space;

(b) a layer of substantially felt-like material applied to the outer surface of said hollow core;

(c) the overall weight of said ball is between 45 and 54 grams;

(d) the pressure in said interior space is from 0.0 to 0.4 $kg/cm^2$ higher than the atmospheric pressure;

(e) the thickness of said hollow core is between 3.0 and 4.5 mm;

(f) the hardness of a rubber of said hollow core is between 60 and 75 based on JIS A standard; and (g) the rebound of said ball is between 125 and 135 cm when dropped, from a height of 254 cm, onto a concrete base.

2. A hollow tennis ball comprising:

(a) a hollow spherical core of elastic material enclosing an interior space;

(b) a layer of substantially felt-like material applied to the outer surface of said hollow core;

(c) the overall weight of said ball is between 30 and 52 grams;

(d) the pressure in said interior space is from 0.4 to 0.7 $kg/cm^2$ higher than the atmospheric pressure;

(e) the thickness of said hollow core is between 2.2 and 3.0 mm;

(f) the hardness of a rubber of said hollow core is between 55 and 70 based on JIS A standard; and (g) the rebound of said ball is between 130 and 145 cm when dropped, from a height of 254 cm, onto a concrete base.

* * * * *

UNITED STATES PATENT AND TRADEMARK OFFICE

CERTIFICATE OF CORRECTION

PATENT NO. : 4,947,466

DATED : August 7, 1990

INVENTOR(S) : HORIUCHI et al

It is certified that error appears in the above-identified patent and that said Letters Patent is hereby corrected as shown below:

On the cover page, Item [30], line 2, "Aug. 5, 1987" should read --May 8, 1987--;
line 3, "Jun. 4, 1988" should read --Apr. 6, 1988--.

Signed and Sealed this

Tenth Day of December, 1991

*Attest:*

HARRY F. MANBECK, JR.

*Attesting Officer*

*Commissioner of Patents and Trademarks*